US009674594B2

(12) United States Patent
Li

(10) Patent No.: US 9,674,594 B2
(45) Date of Patent: Jun. 6, 2017

(54) SPEAKER

(75) Inventor: Shengbo Li, Guangdong (CN)

(73) Assignees: Harman International (China) Holdings Co., Ltd., Shenzhen, Guangdong (CN); Harman International Industries, Incorporated, Stamford, CT (US)

( * ) Notice: Subject to any disclaimer, the term of this patent is extended or adjusted under 35 U.S.C. 154(b) by 0 days.

(21) Appl. No.: 14/399,429

(22) PCT Filed: May 8, 2012

(86) PCT No.: PCT/CN2012/075169

§ 371 (c)(1),
(2), (4) Date: Nov. 6, 2014

(87) PCT Pub. No.: WO2013/166650

PCT Pub. Date: Nov. 14, 2013

(65) Prior Publication Data

US 2015/0104057 A1 Apr. 16, 2015

(51) Int. Cl.

| | |
|---|---|
| ***H04R 1/02*** | (2006.01) |
| *H04R 9/06* | (2006.01) |
| *H04R 1/28* | (2006.01) |

(52) U.S. Cl.
CPC ..... *H04R 1/026* (2013.01); *H04R 1/2896* (2013.01); *H04R 1/2834* (2013.01)

(58) Field of Classification Search
CPC ..... H04R 1/283; H04R 1/025; H04R 1/26; H04R 1/24
USPC ..... 381/335, 182, 349, 351, 388, 333, 186
See application file for complete search history.

(56) References Cited

U.S. PATENT DOCUMENTS

| | | | | |
|---|---|---|---|---|
| 7,133,533 | B2 * | 11/2006 | Chick | H04R 1/2834 381/160 |
| 2004/0228500 | A1 | 11/2004 | Stiles | |
| 2005/0276434 | A1 | 12/2005 | Kobayashi et al. | |
| 2008/0199033 | A1 | 8/2008 | Decanio | |
| 2009/0052723 | A1 | 2/2009 | Lin | |
| 2010/0027815 | A1 * | 2/2010 | Burge | H04R 1/2834 381/182 |
| 2010/0111343 | A1 * | 5/2010 | Hsu | 381/335 |
| 2011/0216933 | A1 | 9/2011 | Lan | |

FOREIGN PATENT DOCUMENTS

| | | | |
|---|---|---|---|
| CN | 1408194 | A | 4/2003 |
| CN | 1647580 | A | 7/2005 |
| CN | 102165791 | A | 8/2011 |
| EP | 1659823 | A2 | 5/2006 |

(Continued)

OTHER PUBLICATIONS

German Office Action for corresponding Application No. 11 2012 006 347.3, mailed Dec. 12, 2014, 9 pages.

(Continued)

*Primary Examiner* — Sunita Joshi
(74) *Attorney, Agent, or Firm* — Brooks Kushman P.C.

(57) ABSTRACT

A speaker including one or multiple transducers, an enclosure, and a suspension mounted on the enclosure, wherein the suspension and the enclosure are configured such that the enclosure is capable of vibrating as a result of operation of the transducer so as to produce audible sound.

19 Claims, 2 Drawing Sheets

(56) References Cited

FOREIGN PATENT DOCUMENTS

| | | |
|---|---|---|
| JP | 2004048223 A | 2/2004 |
| WO | 2012051217 A2 | 4/2012 |

OTHER PUBLICATIONS

International Search Report and Written Opinion for corresponding Appln. No. PCT/CN2012/075169, mailed Feb. 21, 2013, 9 pages.
Chinese Office Action and English translation for Application No. 201280073010, dated Feb. 27, 2017, 15 pages.

* cited by examiner

SPEAKER

CROSS-REFERENCE TO RELATED APPLICATION

This application is the U.S. national phase of PCT Application No. PCT/CN2012/075169 filed on 08 May 2012, the disclosure of which is incorporated in its entirety by reference herein.

TECHNICAL FIELD

The present invention relates to a speaker. In particular, the present invention relates to an improved speaker that enhances the audible sound performance of the speaker system, especially in increasing the low frequency response (bass) of the system.

BACKGROUND ART

It has always been an object for the speaker industry to design speakers having enhanced audible sound performance. However, due to some practical limitations, such as size of the speaker and material of the enclosure of the speaker, the achievement of desired sound performance can be very difficult, particularly for speakers having relatively small size.

For a conventional speaker, typically in the form of closed box, the whole enclosure of the speaker should be theoretically designed as rigid as possible. It is normally understood that any vibration of the speaker enclosure will do harm to the sound quality of the speaker system. FIG. 1 shows a diagram of a typical closed box design of a conventional speaker 10, which comprises a transducer 12 that converts the input electric energy to the out sound energy and an enclosure 14.

However, with the conventional structure, only "half" of the sound produced by the speaker system can be heard by people. That is, the sound inside the enclosure generated by the transducer of the speaker system with the phase opposite to the audible sound outside the enclosure may vanish in the enclosure and not be audible to the listener. Indeed, the sound output by the speaker is not favorable particularly in the bass performance. The poor bass performance is further exaggerated in a minimized speaker due to its inherent disadvantage in producing bass sound.

There are some speaker designs that have been proposed to tackle this problem. FIGS. 2 and 3 show a design having a passive radiator and a vented box design, respectively. In fact, the general concepts of both designs are similar, that is, to provide the speaker system with an additional member to redirect the vanished sound energy to produce audible sounds. Normally, a passive radiator looks like a speaker without the magnet and electronic structure attached to it. The major components of a passive radiator are a cone, a suspension, and a frame. The passive radiator is basically a reactionary device as the name suggests. When a driver, such as a subwoofer, is mounted to a sealed speaker enclosure, the physical forward/back movement of the speaker affects the internal air pressure of the enclosure. When a passive radiator is mounted to the same speaker box, the internal air pressure fluctuations caused by the movement of the driving speaker causes the passive radiator to begin to move forward/back as if it was also a driving speaker. When the passive radiator moves, it creates sound frequencies just as a normal driver does. As can be seen in FIG. 2, a passive radiator 22 is provided on the enclosure 24 of the speaker system 20, and creates sound frequencies as a result of the movement thereof caused by the internal air pressure fluctuations, which is caused by the movement of the transducer 26 (the driving speaker) of the speaker system 20. Therefore, the design with a passive radiator 22 makes use of some sound energy inside the enclosure 24, which may otherwise be vanished in a conventional closed box structure, and produces more audible sounds therefrom. Similarly, the vented box design shown in FIG. 3 provides a "bass-reflex" port tube 32 in the speaker system 30 for redirecting the sound energy which may otherwise be vanished and output more audible sounds (mainly the low frequency-bass).

In both designs, the sound energy inside the enclosure of the speaker may be utilized to some extent. With a carefully designed passive radiator 22 or bass-reflex port tube 32, the speaker system 20 or 30 can produce improved sound (mainly bass), as compared with the conventional closed box design. However, as stated above, since it is normally understood that any vibration of the speaker enclosure will do harm to the sound quality of the speaker system, none of the designs in the prior art has tried to make use of the vibration of the speaker enclosure to further improve the sound performance of the speaker system. On the contrary, designers of speaker system almost always try to eliminate the vibration of the speaker enclosure as much as possible.

However, the inventor's study has shown that the vibration of the enclosure of the speaker system can be used to produce even further improved sound performance for a speaker system. Thus, the present invention aims to provide a new speaker that improves the sound performance by utilizing the vibration of the enclosure of the speaker.

SUMMARY OF THE INVENTION

According to one embodiment of the present invention, a speaker comprises a transducer, an enclosure, and a suspension mounted on the enclosure, wherein the suspension and the enclosure are configured such that the enclosure is capable of vibrating as a result of operation of the transducer so as to produce audible sound.

According to a preferred embodiment of the present invention, the enclosure comprises at least a first portion and a second portion with the suspension connected therebetween. The suspension may be made of flexible material such as rubber, foam, Polyvinyl Chloride (PVC), or Polyurethane (PU). Alternatively, the suspension can be configured as a flexible configuration of spring or corrugated paper.

According to a preferred embodiment of the present invention, the first portion of the enclosure is substantially the same weight as the second portion of the enclosure.

According to the embodiment of the present invention, two design variables, namely, the weight of each portion of the enclosure and the compliance of the suspension are used for designing a speaker having desirable sound performance.

According to another embodiment of the present invention, the enclosure comprises a side on which the transducer is mounted. The suspension is disposed on the side and surrounds the first portion of the enclosure. Preferably, the transducer is attached to the first portion of the enclosure through a through hole formed therein. Also, the first portion of the enclosure may have any suitable shape including a circular shape, a rectangular shape or an oval shape. Indeed, in this embodiment, the transducer, the first portion of the enclosure and the suspension collectively function as a passive radiator.

According to a preferred embodiment of the present invention, the respective weight of the first and second portions of the enclosure and a compliance of the suspension are selected for achievement of the vibration of the enclosure.

Preferably, the speaker enclosure in accordance with the present invention may be provided with an elastic stand for preventing any negative effects on the vibration of the enclosure from outside.

BRIEF DESCRIPTION OF THE DRAWINGS

Additional features and advantages of the present invention will become apparent from the following more particular description, as illustrated in the accompanying drawings, wherein.

EMBODIMENTS OF THE INVENTION

Figure 4:
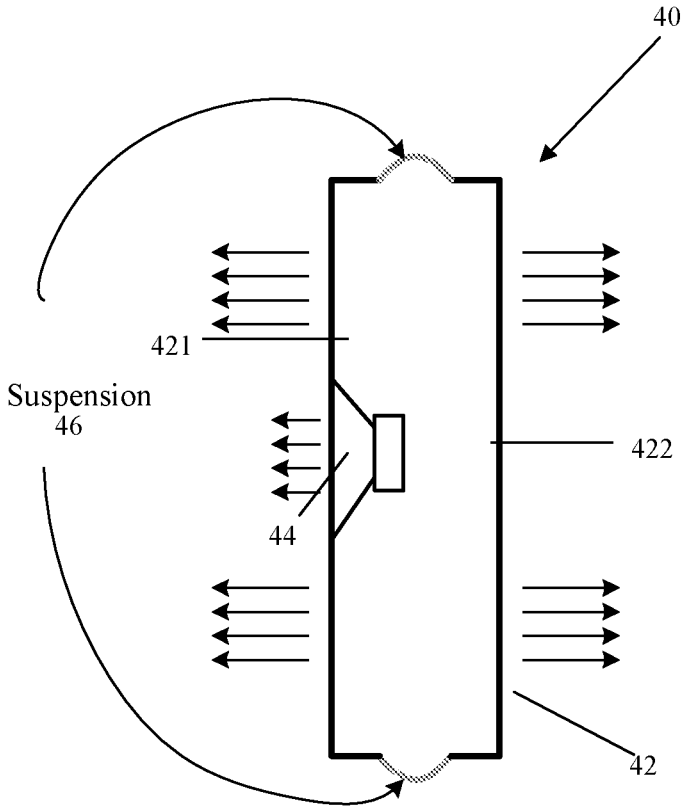
FIG. 4 is a diagram illustrating the structure of a speaker design in accordance with one embodiment of the present invention.

FIG. 4 illustrates the structure of a speaker design in accordance with one embodiment of the present invention. The speaker 40 comprises a speaker enclosure 42 and a transducer 44 provided on the speaker enclosure 42. It is appreciated that the enclosure 42 may be of any suitable material used in the industry, and may also be provided with additional members for functional or aesthetic purpose, such as a stand or a decorative housing. In particular, the speaker enclosure 42 is formed as a two-part member with its first portion 421 connected with its second portion 422 via a flexible suspension 46. The suspension 46 may be made of any suitable flexible materials such as rubber, foam, Polyvinyl Chloride (PVC), or Polyurethane (PU), or may be configured as a flexible configuration such as spring or corrugated paper, as long as the suspension 46 can provide the flexibility for allowance for the relative movements of the two portions of the speaker enclosure 42 with respect to each other.

The transducer 44 may be mounted to either portion of the speaker enclosure 42. Although it is shown in FIG. 4 that one transducer is mounted on the enclosure 42, in practice a plurality of transducers may be feasible. The arrangement of the plurality of transducers may be designed as required. When the transducer 44 operates, the physical forward/back movement of the transducer 44 affects the internal air pressure of the enclosure 42. Due to the connection of the two portions via the suspension 46, the internal air pressure fluctuations causes the two portions of the enclosure 42 to begin vibrating. Such vibration can be used to produce useful sound so as to improve the audible sound performance in the resulting sound output by the speaker 40, particularly in the range of low frequencies. The inventor has found that, for designing a speaker of this concept having desirable sound performance, two design variables, namely, the weight of each portion of the enclosure 42 and the compliance of the suspension 46, are of great significance. Careful selection and optimization of the two parameters can lead to final acoustics of excellence, particularly for the bass performance.

As the speaker in accordance with the present invention makes use of the vibration of the enclosure so as to produce more useful sound, it is desirable that any influence from outside that may negatively affect the vibration of the enclosure should be minimized or even eliminated. For instance, the speaker enclosure 42 may be mounted on an elastic stand for absorbing the vibration of the enclosure 42 and preventing the negative effect on the vibration of the enclosure 42 by virtue of the reaction to the vibration of the enclosure by any rigid stand or surface on which the speaker is placed.

In a preferred embodiment of the present invention, the first portion 421 of the enclosure 42 is substantially the same weight as the second portion 422 of the enclosure 42. It is appreciated that the weights of the first and second portions 421 and 422 of the enclosure 42 may be otherwise designed as required.

Figure 1:
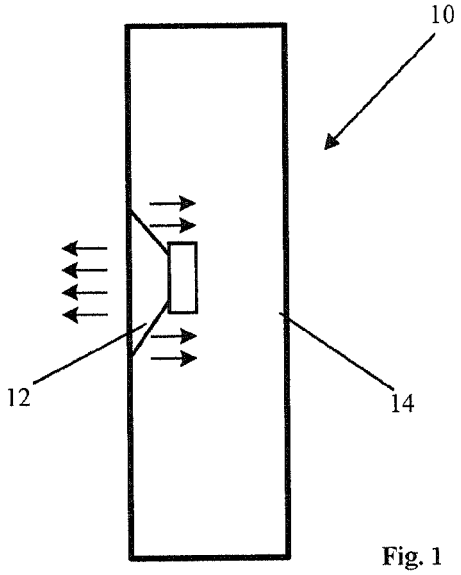
Fig. 1 Prior Art
FIG. 1 is a diagram illustrating the structure of a conventional closed box design of a speaker.
Figure 2:
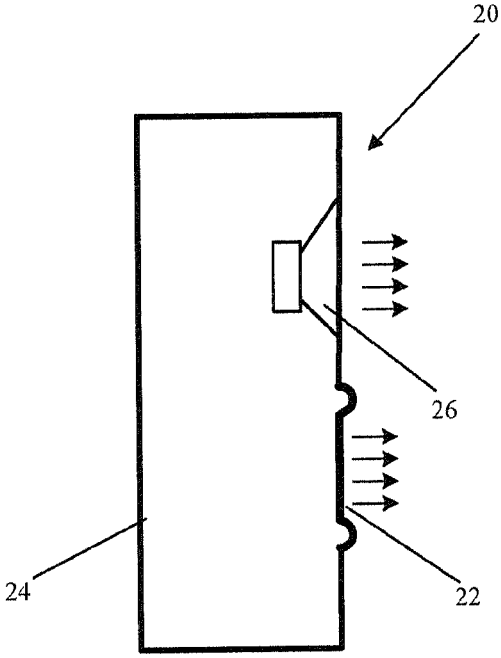
Fig. 2 Prior Art
FIG. 2 is a diagram illustrating the structure of a speaker design having a passive radiator.
Figure 3:
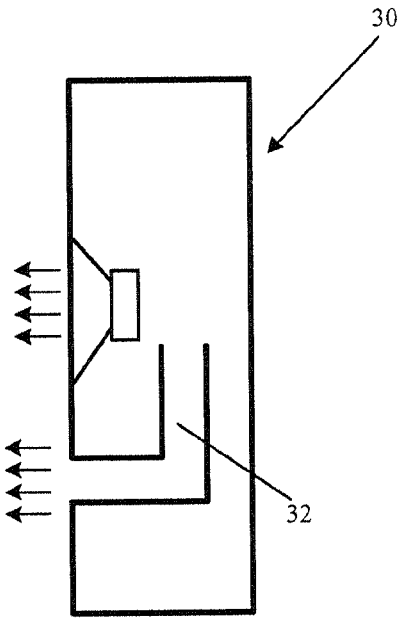
Fig. 3 Prior Art
FIG. 3 is a diagram illustrating the structure of a vented box design of a speaker.

In addition, although a two-part enclosure 42 as an exemplary example is illustrated in FIG. 2, it would be appreciated that an enclosure having more than two parts may be feasible for achieving the object of the present invention. For example, the enclosure may have three or four parts connected by suspension(s) as long as the multiple parts can form a vibration structure that may take use of the air pressure fluctuations for facilitating generation of audible sounds.

Figure 5:
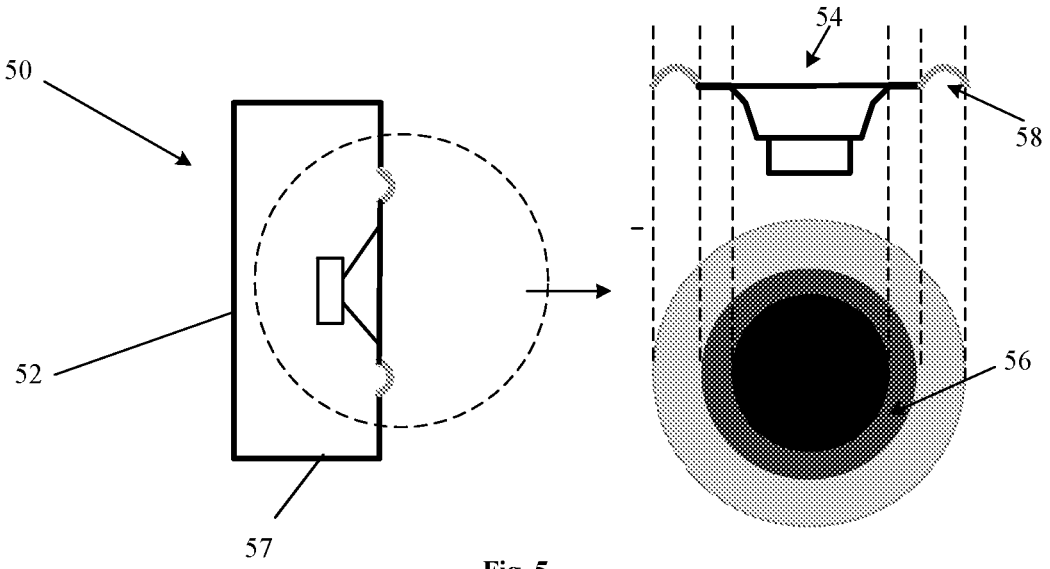
FIG. 5 is a diagram illustrating the structure of a speaker design in accordance with another embodiment of the present invention.

FIG. 5 is a diagram illustrating the structure of a speaker design in accordance with another embodiment of the present invention. The speaker 50 comprises a speaker enclosure 52 and a transducer 54 disposed on one side of the speaker enclosure 52. The enclosure 52 comprises a first portion 56 and a second portion 57, with a suspension 58 connected therebetween. In this exemplary embodiment, the first portion 56 of the enclosure 52 is disposed on the side on which the transducer is mounted and formed with a through hole through which the transducer 54 is attached. The suspension 58 is disposed on the aforesaid side on which the transducer 54 is mounted and surrounds the first portion 56 of the enclosure 52. Depending on the practical requirements, the suspension 58 may be attached to the first and second portions 56, 57 of the enclosure through adhesives or by welding. While it is shown in FIG. 5 that the first portion 56 of the enclosure 52 has a circular shape, it is appreciated that the first portion 56 can be of any shape such as a rectangle or an oval. In fact, the transducer 54, the first portion 56 of the enclosure 52 and the suspension 58 collectively form as a passive radiator in the operation of the speaker 50 in accordance with this embodiment. In particular, the enclosure 52 of the speaker 50 is designed to be capable of vibrating via the suspension 58 connecting the first portion 56 and the second portion 57 of the enclosure 52, thereby facilitating production of more audible sounds from the speaker 50.

More specifically, when the transducer 54 of the speaker 50 operates, due to the suspension 58 connected to the first portion 56 of the enclosure 52, the combination of the transducer 54 and the first portion 56 moves forward/back as a passive radiator. Also, the whole enclosure 52 comprising the first portion 56 and the second portion 57 is designed to vibrate as a result of the air pressure fluctuations inside the enclosure 52 through the suspension 58 connecting the first portion 56 and the second portion 57. As stated above, such vibration can be used to produce useful sound so as to improve the audible sound performance in the resulting sound output by the speaker 50, particularly in the range of low frequencies. In this case, a designer may optimize the respective weights of the first portion 56 and the second portion 57 of the enclosure 52 as well as the compliance of the suspension 58 for achieving desirable final acoustics of the sound output from the speaker system 50.

Furthermore, the embodiment shown in FIG. 5 is advantageous in that the transducer 54, the first portion 56 of the enclosure and the suspension 58 collectively form as a minimized passive radiator. As indicated above, the transducer 54 is attached to the first portion 56 of the enclosure via a through hole formed therein, thereby forming a passive radiator together with the first portion 56 and the suspension 58. As compared with the speaker having a separate passive radiator shown in FIG. 2, this design may facilitate the minimization of the speaker. Also, the design of this embodiment makes it possible to use the transducer itself as a functioning mass of the passive radiator, thereby reducing the amount of the conventional mass used on the passive radiator, which is usually costly.

In summary, the invention relates to an improved speaker that enhances the audible sound performance of the speaker system, especially in increasing the low frequency response of the system. This is achieved mainly by making use of the vibration of the speaker enclosure to produce more useful sounds, thereby improving the final acoustics of the speaker system.

From the foregoing, it will be appreciated that although specific embodiments of the invention have been described herein for purposes of illustration, various modifications may be made without deviating from the spirit or scope of the invention. It is therefore intended that the foregoing detailed description be regarded as illustrative rather than limiting, and that it be understood that it is the following claims, including all equivalents, that are intended to particularly point out and distinctly claim the subject matter regarded as the invention.

The invention claimed is:

1. A speaker comprising a transducer, an enclosure, and a suspension mounted on the enclosure, wherein the suspension and the enclosure are configured to promote vibration of the enclosure as a result of operation of the transducer so as to produce audible sound, wherein the enclosure comprises at least a first portion and a second portion with the suspension connected therebetween, wherein the suspension is positioned on an outer surface of the enclosure and a first axis extends through the suspension, and wherein the transducer is positioned on the outer surface of the enclosure and a second axis extends through the transducer, the first axis being perpendicular to the second axis.

2. The speaker of claim 1 further comprising a plurality of transducers.

3. The speaker of claim 1, wherein the suspension is made of a flexible material.

4. The speaker of claim 3, wherein the flexible material comprises rubber, foam, Polyvinyl Chloride, or Polyurethane.

5. The speaker of claim 1, wherein the suspension is configured as a flexible configuration of spring or corrugated paper.

6. The speaker of claim 1, wherein a respective weight of the first portion and the second portion of the enclosure and a compliance of the suspension are selected for achievement of the vibration of the enclosure.

7. The speaker of claim 1, wherein the enclosure comprises a side on which the transducer is mounted, the suspension being disposed on said side and surrounding the first portion of the enclosure.

8. The speaker of claim 7, wherein the transducer is attached to the first portion of the enclosure through a through hole formed therein.

9. The speaker of claim 8, wherein the first portion of the enclosure has a circular shape, a rectangular shape or an oval shape.

10. The speaker of claim 1, wherein the enclosure is mounted on an elastic stand.

11. The speaker of claim 7, wherein the transducer, the first portion of the enclosure and the suspension collectively function as a passive radiator.

12. A speaker comprising:

a transducer;

an enclosure including a first portion and a second portion that is separate from one another; and a suspension positioned between the first portion and the second portion, wherein the suspension and the enclosure are configured to promote vibration of the enclosure as a result of operation of the transducer to produce an audible sound, wherein the suspension is positioned on an outer surface of the enclosure and a first axis extends through the suspension, and wherein the transducer is positioned on the outer surface of the enclosure and a second axis extends through the transducer, the first axis being perpendicular to the second axis.

13. The speaker of claim 12 further comprising a plurality of transducers.

14. The speaker of claim 12, wherein the suspension is made of flexible material.

15. A speaker comprising:

a transducer;

an enclosure including a first portion and a second portion, the first portion being separate from the second portion and defining a through hole therein to receive the transducer; and a suspension connected to the first portion and to the second portion, wherein the suspension and the enclosure are configured to promote vibration of the enclosure as a result of operation of the transducer to produce an audible sound, wherein the suspension is positioned on an outer surface of the enclosure and a first axis extends through the suspension, and wherein the transducer is positioned on the outer surface of the enclosure and a second axis extends through the transducer, the first axis being perpendicular to the second axis.

16. The speaker of claim 15, wherein the suspension is made of flexible material.

17. The speaker of claim 1, wherein the first portion of the enclosure is substantially a same weight as the second portion of the enclosure.

18. The speaker of claim 12, wherein the first portion of the enclosure is substantially a same weight as the second portion of the enclosure.

19. The speaker of claim 15, wherein the first portion of the enclosure is substantially a same weight as the second portion of the enclosure.

* * * * *